US005183476A

United States Patent [19]

Carlsson et al.

[11] Patent Number: 5,183,476

[45] Date of Patent: Feb. 2, 1993

[54] ETHANOL FUEL AND ITS USE AS A DIESEL FUEL

[75] Inventors: Göran Carlsson, Nykvarn; Martin Hellsten, Ödsmål, both of Sweden

[73] Assignee: Berol Nobel Stenungsund AB, Stenungsund, Sweden

[21] Appl. No.: 571,591

[22] PCT Filed: Feb. 10, 1989

[86] PCT No.: PCT/SE89/00055

§ 371 Date: Aug. 22, 1990

§ 102(e) Date: Aug. 22, 1990

[87] PCT Pub. No.: WO89/07637

PCT Pub. Date: Aug. 24, 1989

[30] Foreign Application Priority Data

Feb. 22, 1988 [SE] Sweden ..... 8800597

[51] Int. Cl.[5] ..... C10L 1/02

[52] U.S. Cl. ..... 44/445; 44/451

[58] Field of Search ..... 44/445, 451

[56] References Cited

U.S. PATENT DOCUMENTS 4,298,352 11/1981 Blysing ..... 44/435
4,333,739 6/1982 Neves ..... 44/451
4,659,335 4/1987 Wegner et al. ..... 44/434

FOREIGN PATENT DOCUMENTS 14992 9/1980 European Pat. Off. .
0183447 6/1986 European Pat. Off. .
3412078 10/1985 Fed. Rep. of Germany .
3509407 3/1986 Fed. Rep. of Germany .
3628504 3/1987 Fed. Rep. of Germany .
3631225 4/1987 Fed. Rep. of Germany .
7713748 7/1979 Sweden .
2143846 7/1983 United Kingdom .
2181155 4/1987 United Kingdom .

OTHER PUBLICATIONS

Pat. Abstracts of Japan, vol. 9, No. 104, (C-279) published Dec. 26, 1984.

*Primary Examiner*—Olik Chaudhuri
*Assistant Examiner*—M. Nuzzolillo
*Attorney, Agent, or Firm*—Spencer, Frank & Schneider

[57] ABSTRACT

A fuel which is ethanol-based and which has the form of a solution includes from 62–94% by weight of ethanol; from 2–8% by weight of water; from 2–30% by weight of an ignition improving agent comprised of a water-soluble polyalkylene glycol compound containing 6–50 alkyleneoxy units with 2–4 carbon atoms and having a molecular weight of less than 2500. Such fuel is useful for fueling diesel engines and has excellent combustibility while emitting a low content of organic hydrocarbons. At the same time, the polyalkylene glycol ignition improving agent is odorless, non-toxic, stable in storage, and does not emit nitrogen oxides when combusted.

17 Claims, No Drawings

ETHANOL FUEL AND ITS USE AS A DIESEL FUEL

BACKGROUND OF THE INVENTION

1. Field of the Invention

The present invention relates to an ethanol fuel which contains polyalkylene glycol compounds as an ignition-improving agent.

2. Background of the Related Art

In a diesel engine, the combustion air is compressed to about 40 bars, the air reaching a temperature sufficiently high to ignite the diesel oil which is being injected. For gas oil, the temperature of use is specified at 336° C., and for kerosene at 295° C. For anhydrous ethanol, the ignition temperature in air is specified at 558° C., and in oxygen gas at 425° C. Morover, the evaporation of ethanol corresponds to a cooling of air by about 125° C. in a stoichiometric relationship between ethanol and air. Thus, because of the high ignition temperature of the ethanol, it is not possible to use pure ethanol as fuel in a conventional diesel engine.

One way of igniting the ethanol fuel is to provide the diesel engine with spark plugs, but this necessitates extensive modifications to the engine's construction. For conventional diesel engines, a so-called ignition-improving agent, i.e., an agent which serves to lower the ignition temperature of the fuel, has been added to the ethanol. The predominant ignition-improving agent is the group consisting of alkyl nitrates, and the most used substrance is 2-ethylhexyl nitrate, generally abbreviated EHN.

EHN, which has a rather strong and disagreeable odour, is toxic and can be hydrolyzed to nitric acid and 2-ethylhexanol when stored for long periods of time, especially at elevated temperature. The hydrolysis causes a marked lowering of the pH, implying a serious risk of corrosion. A further serious objection to EHN is that the substance contains nitrogen which may increase the emission of nitrogen oxides in the exhaust gases. Therefore, it is generally desirable that EHN and other nitrate-based ignition-improving agents be replaced by an agent which is less hazardous to the environment and has higher stability.

It is also known to add corrosion inhibitors and lubricants to fuels. German Patent Application A1, 3,628,504 describes a fuel mixture of hydrocarbons, an alcohol and a corrosion inhibitor in an amount of up to 5000 ppm. This inhibitor contains a surface active agent, e.g., block polymers of alkylene oxides.

British Patent Application A2, 143,846 discloses the use of 0.005–0.05% by weight of a polyalkylene glycol as a lubricity improver in a diesel fuel based on methanol and/or ethanol.

SUMMARY OF THE INVENTION

It has been found that the above-mentioned disadvantages of EHN can be eliminated if polyalkylene glycol compounds are used as ignition-improving agent in ethanol fuel. The ethanol fuel according to the invention is characterised in that it is in the form of a solution and contains 62–94%, preferably 70–85%, of ethanol, 2–8%, preferably 3–6%, of water, and at least 1%, suitably 2–30%, and preferably 8–25%, of a water-soluble polyalkylene glycol compound which contains 6–50 alkylene oxide units having 2–4 carbon atoms and which has a molecular weight of less than 2500.

Specific examples of such polyalkylene glycol compounds are those which can be expressed by the general formula $$RO(A)_nH,$$

wherein R is hydrogen or a hydrocarbon group having 1–30 carbon atoms, A is an alkylene oxide group having 2–3 carbon atoms, at least 20% of all alkylene oxide groups being ethylene oxide groups, and n is an integer selected such that the polyalkylene glycol compound has a molecular weight of from 300 to 2000, preferably from 400 to 1000.

Other useful polyalkylene glycol compounds are compounds in which alkylene oxide having 2–3 carbon atoms has been combined with a thiol compound, a carboxylic acid, a primary or secondary amine, or an alkanol amine in such an amount that the polyalkylene glycol compound will obtain the required molecular weight.

In a conventional diesel engine, the addition of the polyalkylene glycol compound preferably amounts to 12–20% by weight, but by optimizing the engine, e.g., by increasing the compression ratio and/or preheating of inlet air, the addition can be reduced, preferably to 2–12% by weight. The ethanol composition of the present invention has an excellent inflammability, and the polyalkylene glycol compounds are odourless, nontoxic and stable in storage. Since they can easily be chosen in such a manner that they only contain carbon, oxygen and hydrogen, their combustion constitutes no hazard to the environment, and tests have shown that the ethanol fuel according to the invention has excellent combustibility, and that the content of organic hydrocarbons is low, usually far below 1000 ppm.

It is important that the polyalkylene glycol compounds have a molecular weight higher than 300, because compounds of lower molecular weight have an ignition-improving effect which is far too low, whereas compounds having a molecular weight higher than about 2500 are not sufficiently soluble in the ethanol fuel. If large amounts of polyalkylene glycol compound are added, the molecular weight thereof should not exceed 1000 in order to ensure satisfactory solubility in the ethanol fuel. The polyalkylene glycol compounds according to the invention may be derived from both ethylene oxide and mixtures of ethylene oxide and propylene oxide. If mixtures of ethylene oxide and propylene oxide are used, these may be both randomly combined and combined in one or several blocks. The alkylene oxides can also be combined with a compound containing active hydrogen, such as an alcohol, a carboxylic acid, an amine, a thiol or a phenol compound. The alcohol, carboxylic acid, amine or thiol is preferably selected such that it contains 1–16 carbon atoms, and the phenol compound such that it contains 6–15 carbon atoms.

Preferably, the polyalkylene glycol compounds are essentially free from ashes, e.g., lower than 0.02%, in order to minimize deposits in cylinders and exhaust catalytic converters. Normally, the polyalkylene glycol compounds contain ashes derived from the metal compounds used in the production. These metal compounds may be removed by ionic exchange or by precipitation followed by filtration. Another method to obtain ash-free polyalkylene glycols is to use organic ash-free compounds as catalysts in the production.

Besides ethanol, water and the polyalkylene glycol compounds, the fuel according to the invention may also contain a number of conventional additives, such as corrosion inhibitors, lubrication-improving agents and denaturants.

DETAILED DESCRIPTION OF THE PREFERRED EMBODIMENTS

To further illustrate the present invention, the following Examples are given.

EXAMPLE 1

Different ethanol fuels were tested in a sixcylinder supercharged laboratory diesel engine having a compression ratio of 18:1. The fuel injectors had five holes with a diameter of 0.42 mm. During the test, the content of organic hydrocarbons in the exhaust gases at different engine speeds and at a load of 2% was determined. The ethanol fuels tested contained 60.8 parts by weight of ethanol, 3.2 parts by weight of water and 22 parts by weight of polyethylene glycol of molecular weight of 400 (PEG 400), or 20 parts by weight of an adduct consisting of nonyl phenol combined with 16 moles of EO (NF+16 EO), or of dinonyl phenol combined with 20 moles of alkylene oxide consisting of a mixture of 30% ethylene oxide and 70% propylene oxide (DNF+(6 EP+14 PO)). The following results were obtained.

TABLE I

| Test | Engine speed rpm | PEG400 | Hydrocarbon content, ppm NF + 16EO | DNF + (6EO + 14PO) |
|---|---|---|---|---|
| 1 | 1800 | 630 | 650 | 790 |
| 2 | 2000 | 600 | 620 | 750 |
| 3 | 2200 | 610 | 630 | 750 |

The results show that the ethanol fuel according to the invention can advantageously be used as a diesel fuel, and that the hydrocarbon content in the exhaust gases is essentially below 1000 ppm. Contents above 1000 ppm in the exhaust gases are unacceptable for environmental reasons.

EXAMPLE 2

Test were conducted with the same diesel engine as in Example 1. The diesel engine was warmed up at 1300 rpm at a load of 550 Nm, whereupon the engine was run for ten minutes at idle speed. The diesel fuel consisted of 60.8 parts by weight of ethanol, 3.2 parts by weight of water, and 14 or, alternatively, 17 parts by weight of polyalkylene glycol compound consisting of nonyl phenol combined with 16 moles of ethylene oxide per moles of nonyl phenol (NF+16 EO). For some tests, the engine was also equipped with a catalyser for exhaust purification.

TABLE II

| Test | Engine speed rpm | Time, min | Additive parts by weight | Hydrocarbon content, ppm with catalyst | without catalyst |
|---|---|---|---|---|---|
| 4 | 1300 | 0 | 14 | 45 | 270 |
| 5 | 500 | 1 | 14 | 25 | 300 |
| 6 | 500 | 2 | 14 | 40 | 450 |
| 7 | 500 | 3 | 14 | 70 | 530 |
| 8 | 500 | 4 | 14 | 180 | 570 |
| 9 | 500 | 5 | 14 | 370 | 600 |
| 10 | 500 | 7 | 14 | 620 | 670 |
| 11 | 500 | 10 | 14 | 610 | 660 |

TABLE II-continued

| Test | Engine speed rpm | Time, min | Additive parts by weight | Hydrocarbon content, ppm with catalyst | without catalyst |
|---|---|---|---|---|---|
| 12 | 1300 | 0 | 17 | 40 | — |
| 13 | 500 | 1 | 17 | 25 | — |
| 14 | 500 | 2 | 17 | 40 | — |
| 15 | 500 | 3 | 17 | 50 | — |
| 16 | 500 | 4 | 17 | 110 | — |
| 17 | 500 | 5 | 17 | 210 | — |
| 18 | 500 | 7 | 17 | 480 | — |
| 19 | 500 | 10 | 17 | 500 | — |

The results show that also during idling, when the hydrocarbon emission of a diesel engine normally is very high, the hydrocarbon content will stay well below 1,000 ppm when an ethanol fuel according to the present invention is used.

EXAMPLE 3

In the same way as in Example 1, a ethanol fuel was tested at 2,000 rpm. The ethanol fuel contained 60.8 parts by weight of ethanol, 3.2 parts by weight of water and 18.7 parts by weight of polyethylene glycol having a molecular weight of 600. The exhaust gases were found to contain 650 ppm of organic hydrocarbons.

What is claimed is:

1. A fuel which is ethanol-based and which has the form of a solution, the fuel comprising:
   from 62–94% by weight of ethanol;
   from 2–8% by weight of water; and
   from 2–30% by weight of an ignition improving agent consisting essentially of a water-soluble polyalkylene glycol compound containing 6–50 alkyleneoxy units with 2–4 carbon atoms and having a molecular weight of less than 2500, wherein the water-soluble polyalkylene glycol compound has a general formula $$R\,O(A)_nH,$$

in which R is a hydrogen or a hydrocarbon group having 1–30 atoms, A is an alkyleneoxy group having 2–3 carbon atoms and at least 20% of all alkyleneoxy groups being ethyleneoxy groups, and n is an integer selected so that the polyalkylene glycol compound has a molecular weight ranging from 400 to 1000.

2. The fuel according to claim 1, containing from 70–85% by weight of ethanol, from 3–6% by weight of water, and from 2–20% by weight of the water-soluble polyalkylene glycol compound.

3. The fuel according to claim 1, wherein the water-soluble polyalkylene glycol has an ash content of less than 0.02%.

4. The process of fueling a diesel engine, comprising:
   providing a fuel having the form of a solution and containing:
   from 62–94% by weight of ethanol;
   from 2–8% by weight of water; and
   from 2–30% by weight of an ignition improving agent consisting essentially of a water-soluble polyalkylene glycol compound containing 6–50 alkyleneoxy units having 2–4 carbon atoms and having a molecular weight of less than 2500, wherein the water-soluble polyalkylene glycol compound a general formula $RO(A)_nH$, in which R is a hydrogen or a hydrocarbon group having 1–30 atoms, A is an alkyleneoxy group having 2–3 carbon atoms and at least 20% of all alkyleneoxy groups being ethyleneoxy groups, and n is an integer selected so that the polyalkylene glycol compound has a molecular weight ranging from 400 to 1000.

5. The process according to claim 4, wherein the fuel contains from 70–85% by weight of ethanol, from 3–6% by weight of water, and from 2–20% by weight of the water-soluble polyalkylene glycol compound.

6. The process according to claim 4, wherein the water-soluble polyalkylene glycol compound has an ash content of less than 0.02%.

7. The fuel according to claim 1, containing from 70–85% by weight of ethanol, from 3–6% by weight of water, and from 2–20% by weight of the water-soluble polyalkylene glycol compound.

8. The fuel according to claim 1, wherein the water-soluble glycol compound has a molecular weight ranging from 400–1000.

9. The fuel according to claim 1, wherein the water-soluble polyalkylene glycol has an ash content of less than 0.02%.

10. The fuel according to claim 2, wherein the water-soluble glycol compound has a molecular weight ranging from 400–1000.

11. The fuel according to claim 2, wherein the water-soluble polyalkylene glycol has an ash content of less than 0.02%.

12. The fuel according to claim 1, wherein the water-soluble polyalkylene glycol has an ash content of less than 0.02%.

13. The process according to claim 4, wherein the fuel contains from 70–85% by weight of ethanol, from 3–6% by weight of water, and from 2–20% by weight of the water-soluble polyalkylene glycol compound.

14. The process according to claim 4, wherein the water-soluble polyalkylene glycol compound has a molecular weight ranging from 400–1000.

15. The process according to claim 4, wherein the water-soluble polyalkylene glycol compound has an ash content of less than 0.02%.

16. the process according to claim 5, wherein the water-soluble polyalkylene glycol compound has a molecular weight ranging from 400–1000.

17. The process according to claim 5, wherein the water-soluble polyalkylene glycol compound has an ash content of less than 0.02%.

* * * * *